United States Patent [19]

Gerber

[11] Patent Number: 4,685,363

[45] Date of Patent: Aug. 11, 1987

[54] APPARATUS AND METHOD FOR SUPPORTING AND WORKING ON SHEET MATERIAL

[75] Inventor: Heinz J. Gerber, West Hartford, Conn.

[73] Assignee: Gerber Scientific, Inc., Windsor, Conn.

[21] Appl. No.: 928,637

[22] Filed: Nov. 6, 1986

Related U.S. Application Data

[63] Continuation of Ser. No. 736,839, May 22, 1985, abandoned.

[51] Int. Cl.[4] ..... B26D 7/08; B26D 7/20

[52] U.S. Cl. ..... 83/22; 83/451; 83/925 CC; 269/21; 269/53; 269/289 R

[58] Field of Search ..... 83/451, 925 CC, 402, 83/374, 747, 22, 14; 269/21, 289 R, 53; 30/375

[56] References Cited

U.S. PATENT DOCUMENTS

| | | | |
|---|---|---|---|
| 245,150 | 8/1881 | Fowler | 30/275 |
| 3,052,339 | 9/1962 | Carter | 83/402 |
| 3,800,641 | 4/1974 | Spengler | 83/925 CC |
| 3,877,334 | 4/1975 | Gerber | 83/451 X |
| 3,942,781 | 3/1976 | Gerber | 83/925 CC |
| 4,205,835 | 6/1980 | Gerber | 269/289 R |
| 4,312,254 | 1/1982 | Pearl | 83/451 X |
| 4,322,993 | 4/1982 | Stumpf | 83/925 CC |
| 4,373,412 | 2/1983 | Gerber | 83/925 CC |
| 4,494,433 | 1/1985 | Gerber | 83/374 |

*Primary Examiner*—Frank T. Yost
*Assistant Examiner*—Hien H. Phan
*Attorney, Agent, or Firm*—McCormick, Paulding & Huber

[57] ABSTRACT

A bed for supporting sheet material to be cut or otherwise worked on is made of a densely packed array of relatively short, stiff bristles with pointed upper ends which penetrate the sheet material to inhibit it from moving laterally relative to the bed. Vacuum may be used in the space containing the bristles to aid in holding the sheet material to the bed and to normalize the holding effect of the bristles with respect to different sheet materials. Pressurized air may also be used in the bristle space to aid in removing cut sheet material from the bed and the bristles are shaped to facilitate such removal. Various different cutters are useable with the bed to provide a complete sheet material cutting machine.

16 Claims, 26 Drawing Figures

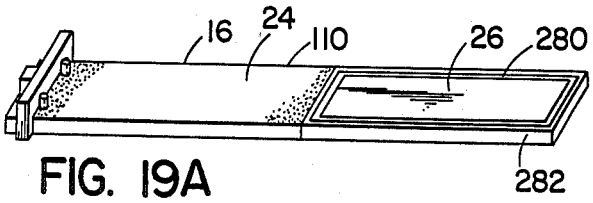

FIG. 19A

SPREAD PENETRABLE SHEET 26 ONTO IMPENETRABLE SHEET 280 ON SPREADING TABLE 282

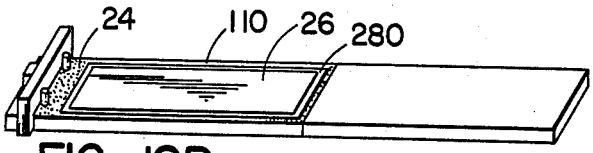

FIG. 19B

MOVE SHEETS 26 AND 280 ONTO SUPPORT SURFACE 24 OF CUTTING TABLE 16, POSSIBLY USING PRESSURIZED AIR IN BRISTLE BED 110

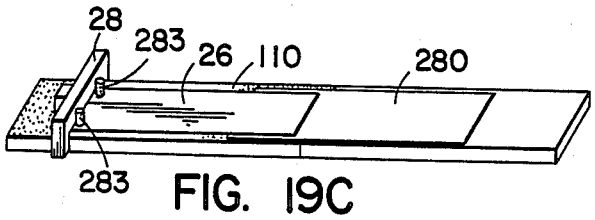

FIG. 19C

PULL SHEET 280 OUT FROM UNDER SHEET 26, POSSIBLY USING PRESSURIZED AIR IN BRISTLE BED 110

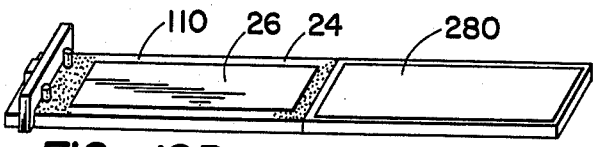

FIG. 19D

LEAVE SHEET 26 DEPOSITED BY ITSELF ON SUPPORT SURFACE 24, POSSIBLY NOW APPLYING VACUUM TO THE BRISTLE BED 110

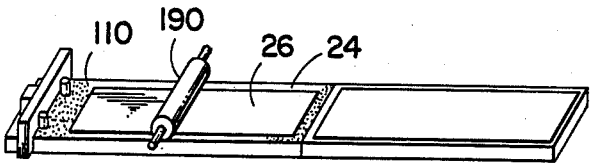

FIG. 19E

MOVE ROLLER 190 OVER SHEET 26 TO PRESS IT ONTO POINTED BRISTLES OF BRISTLE BED 110, POSSIBLY USING VACUUM IN BRISTLE BED 110

CUT PATTERN PIECES FROM SHEET 26, POSSIBLY USING VACUUM IN BRISTLE BED 110

REMOVE PATTERN PIECES FROM THE SUPPORT SURFACE 24, POSSIBLY USING PRESSURIZED AIR IN THE BRISTLE BED 110

APPARATUS AND METHOD FOR SUPPORTING AND WORKING ON SHEET MATERIAL

This is a continuation of co-pending application Ser. No. 736,839, filed on May 22, 1985, now abandoned.

BACKGROUND OF THE INVENTION

This invention relates to apparatus and methods for working on flexible sheet material such as fabric webs from which garments or upholstery are made, and deals more particularly with apparatus and methods for supporting such sheet material in a spread condition and for cutting or otherwise working on such sheet material while so supported.

In the past it has been well known to cut fabric and other sheet material by spreading it either as a single layer or as a layup of a number of layers over a supporting surface and to then cut the single layer or layup to produce pattern pieces by moving a cutter either by hand or automatic control along desired lines of cut. It is also well known to make such supporting surface penetrable by the cutting tool of the cutter so that in the cutting process the tool may not only pass completely through the material being cut but may also extend some distance downwardly beyond the supporting surface and into the bed of material providing such surface.

The use of bristles to form a penetrable supporting surface in a cloth cutting machine is known in the art and is shown for example in U.S. Pat. Nos. 2,445,150; 3,548,697; 3,776,072; 3,942,781; 4,205,835; and 4,391,170. The general aim of the prior art bristle beds as exemplified by most of these patents has been to provide a substantially continuous supporting surface for the sheet material to be cut so that the support surface acts as an anvil in conjunction with the cutting tool. That is, the desire has been to provide a supporting surface which rigidly backs up the sheet material supported thereon to prevent the material from moving downwardly when a downward pressure is applied to the material as by a reciprocating cutting tool, while nevertheless allowing a sharp cutting edge of a cutting tool to pass downwardly beyond the supporting surface into the space occupied by the bristles. This anvil type supporting surface has been obtained in part by using bristles with flat or blunt surfaces at their upper ends.

Bristle beds of the known type providing anvil-like supporting surfaces have the disadvantage that material spread on such supporting surface tends to be easily displaced in the plane of the supporting surface when subjected to a force appearing in that plane as for example the force exerted thereon by a forwardly facing cutting edge of a cutting tool, or by the undersurface of a presser foot, moved forwardly along a line of cut relative to the material during a cutting procedure. This tendency of the material to move or shift in the plane of the supporting surface causes cutting errors and is due both to a tendency of the material to slip relative to the ends of the bristles and also due to the tendency of the bristles to bend, the bristles usually being relatively long and thin and therefore quite flexible.

The general aim of the invention is therefore to provide a bristle bed providing a supporting surface for holding sheet material in a cloth cutting machine or the like which bristle bed cooperates with the material spread thereon to inhibit its movement in the plane of the supporting surface. In keeping with this object, further objects of the invention are to inhibit the lateral movement of the material spread on the supporting surface both by reducing or eliminating slippage of the material relative to the bristles and by reducing bending of the bristles.

A further object of the invention is to provide a bristle bed, or a machine using a bristle bed, of the foregoing character wherein the holding effect of the bed with respect to sheet material spread onto it is normalized so as to be substantially the same for different types of materials ranging for example from hard tightly woven ones to soft loosely woven ones.

Another object of the invention is to provide a cloth cutting machine particularly well adapted to the efficient cutting of either a single sheet of material or of a low layup of several sheets of material without the need for covering the single layer or the low layup with a sheet of air-impermeable material which works in conjunction with a vacuum applied to the supporting surface to aid in holding the material in place while it is cut, the machine, however, being useable with such sheet of air-impermeable material combined with a vacuum applied to the supporting surface if desired, which may be of benefit when cutting relatively high layups of material.

Another object of the invention is to provide a bristle bed, or a machine using a bristle bed, wherein when a vacuum is applied to the space containing the bristles the flow of air is so controlled that the vacuum is channelled substantially directly to areas of a sheet of work material spread on the material supporting surface provided by the bed and so that a portion of the associated area of the supporting surface may be left uncovered by work material or by supplemental air impervious sealing sheet material without drastically reducing the degree of vacuum appearing over the remaining portion of the associated area of the supporting surface.

Another object of the invention is to provide a bristle bed of the foregoing character, and a related method, particularly useful with a vacuum applied to the space containing the bristles to aid in holding sheet material to the supporting surface and also particularly useful with positive air pressure applied to the bristle space to aid in removing cut sheet material from the supporting surface.

Another object of the invention is to provide a bristle bed and machine of the foregoing character, and a related method, wherein the bristles of the bristle bed are of such a size and shape and are packed to such a density that the bristle bed offers a substantial resistance to the flow of air therethrough in a plane parallel to the bed so that when a vacuum is applied to only a portion of the bristle bed the degree of vacuum will gradually diminish with distance from the vacuumized portion.

A still further object of the invention is to provide bristle blocks for constructing bristle beds of the foregoing character and which may be made as simple injection molded plastic units.

Many other objects and advantages of the invention will be apparent from the following description of a number of embodiments of the invention taken in conjunction with the accompanying drawings.

SUMMARY OF THE INVENTION

The invention resides in a bed for supporting sheet material in a spread condition while it is worked upon, the bed being comprised of bristles having ends located in a common plane forming the support surface of the bed and pointed so that the points penetrate at least to some extent into the sheet material spread over the support surface to inhibit movement of the sheet material in the plane of that surface.

The invention also resides in a particular orientation, shape, size and packing of the bristles, those parameters being such that the pointed ends of the bristles readily penetrate the sheet material while nevertheless allowing the sheet material to be smoothly lifted from the bed after cutting, either manually or with the assistance of pressurized air applied to the bed.

The invention also resides in the use of a vacuum with the bristle bed to aid in holding material to the bed as well as to normalize the holding effect of the bed over a wide range of different types of sheet materials.

The invention also resides in the use of a roller or other means for mechanically pressing sheet material onto the pointed bristles of the bed after it is spread onto the supporting surface defined by such pointed bristles.

The invention also resides in cutting machines and methods using bristle beds of the above type, and in particular resides in a cutting machine using such a bed in conjunction with a small, high speed rotary cutting tool which exerts little or no disturbing force on the material being cut in the plane of the support surface and which penetrates into the supporting bed by extending below the support surface only to a very small degree.

The invention also resides in features of bristle blocks which may be used to form bristle beds of the foregoing character.

BRIEF DESCRIPTION OF THE DRAWINGS

FIGS. 19*a* to 19*g* are schematic views representing in sequence the steps of a method embodying the invention for cutting sheet material using a cutting machine such as that of FIG. 1 or FIG. 2.

DETAILED DESCRIPTION OF THE PREFERRED EMBODIMENTS

Figure 1:
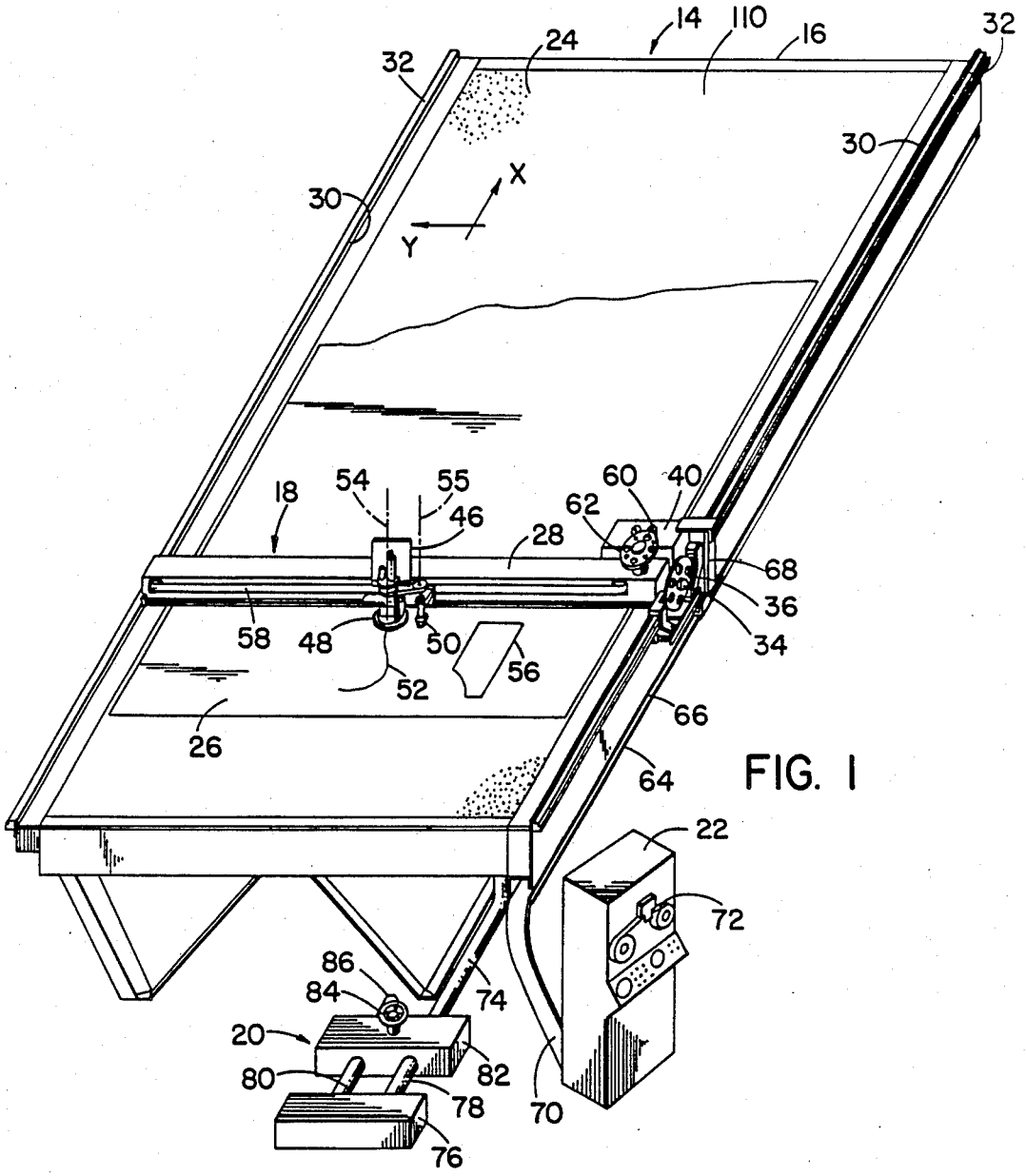
FIG. 1 is a perspective view showing a cloth cutting machine embodying the present invention.

Turning to FIG. 1, the invention is there shown embodied in an apparatus 14 adapted to the cutting of either a single layer or a layup of sheet material spread on a work supporting surface. The apparatus by way of major components is comprised of a cutting table 16, a cutting mechanism 18, an air system 20 and a numerical controller 22.

The table 16 has an elongated, rectangular, horizontal and upwardly facing work support surface 24 which in the illustrated case is used to support a single sheet of cloth 26, as the work material, in a spread condition. In keeping with the invention and as explained in more detail hereinafter, the work support surface 24 is provided by a bristle bed 110 preferably constructed of a plurality of bristle blocks fitted together to form the bed with the bed having a large number of air transmitting passages extending vertically through it to allow air to pass between the work support surface 24 and hollow compartments underlying the surface 24 as part of a system for creating a vacuum over a selected area of the surface 24, to aid in holding in place the material 26 as it is cut, and also possibly for creating a positive air pressure over the entire extent of the surface 24 to aid in moving the material 26 onto or off of the surface 24. The selective vacuumization of different areas of the work surface 24 is not, however, critical to the broader aspects of the invention and in some instances the bristle bed may be used without any vacuum at all or may be used with a vacuum applied over the entire bristle bed at one time. Likewise, the ability to apply pressurized air to the bristle bed is not necessary to some of the broader aspects of the invention and may be omitted in some cases if desired without departing from the invention.

The cutting mechanism 18 includes an X-carriage 28 located above the support surface 24 and moveable in the illustrated X-coordinate direction relative to the table 16. It is supported at its opposite ends by suitable bearings (not shown) engageable with upwardly projecting walls 30, 30 on opposite longitudinal sides of the table. On the outboard surface of each wall is a longitudinally extending rack 32. A drive shaft 34, having a drive gear 36 fixed to its right hand end, as seen in FIG. 1, extends through the carriage 28 and has a pinion (not shown) on each of its opposite ends engageable with the associated rack 32 to move the carriage in the X-direction in response to rotation of the drive gear 36 and the shaft 34. Carried by a service module 40 fixed to the right hand end of the X-carriage, as seen in FIG. 1, is an X-motor (not shown) having an output pinion which meshes with the drive gear 36.

Supported on the X-carriage 28 for movement relative to it in the illustrated Y-coordinate direction, is a Y-carriage 46 which carries one or more work tools for working on the work material 26 spread on the supporting surface 24. These tools may take various different forms without departing from the broader aspects of the invention, but in the illustrated case they are shown to consist of a rotary blade cutter head 48 and a reciprocating blade cutter head 50. As explained in more detail hereinafter in conection with FIGS. 12 and 13, the head 48 has a blade, rotatable about a generally horizontal axis, to cut the material 26 along a given line of cut 52 as the head 48 is moved along such line, under control of the controller 22, by combined movement of the X-carriage 28 and Y-carriage 46 in the X and Y-coordinate directions. During such movement the portion of the head 48 carrying the rotating blade is moveable about a vertical theta axis 54 to maintain the cutting blade tangent to the line of cut 52, and the vertically extending blade of the reciprocating blade cutter 50 is likewise moveable about a vertical theta axis 55. In general, the cutter head 48 is used to cut pattern pieces from the material 26 with one such pattern piece being shown for example at 56. The head 50 has a vertically moveable blade and may be used to cut notch marks in the pattern pieces cut by the cutter head 48. It can also be used to cut some portions of the lines of cut defining the pattern pieces as, for example, portions of such lines having curvatures smaller than easily cut by the rotary blade cutter head 48.

The Y-carriage 46 is moved in the Y-coordinate direction by a belt 58 passing over pulleys at the opposite ends of the Y-carriage 28. The right hand one of these pulleys, as seen in FIG. 1, is driven by a Y-motor (not shown) contained in the service module 40 and having a pinion 60 on its drive shaft which meshes with the a drive gear 62 in turn drivingly connected with the right hand belt pulley.

Power and electrical commands for operating the X and Y-drive motors in the service module 40 and for operating the cutter heads 48 and 50 are supplied from a ribbon cable contained in a cable housing 64 running along the right hand side of the table and having a longitudinally extending slot 66 providing access to the cable. One end of the cable is connected to a conductor carrying arm 68 connected to the X-carriage 28 and the other end of the cable is connected to the numerical controller 22 through a connecting cable 70 which may be a continuation of the cable contained in the housing 64.

The numerical controller 22 which may, as illustrated, operate in response to instructions recorded on magnetic tape 72, provides the power and commands needed to operate the cutting table 16, and in particular to move the cutter head 48 along the desired lines of cut on the work material 26.

The air system 20 is connected to the table through a supply conduit 74 and operates to selectively apply either a vacuum or positive air pressure to that conduit. For this reason, the system consists of an air blower or pump 76 having both a vacuum port 78 and a pressure port 80. Connected between the pump 76 and supply conduit 74 is a valve mechanism 82 manually operable by a handle 84 for selectively connecting the supply conduit 74 to either the vacuum port 78 or the pressure port 80. The port 78 or 80 not connected to the supply conduit 74 is connected by the valve mechanism 82 to an atmospheric port 86. Therefore, if the valve mechanism 82 is set to supply a vacuum to the table 16 air will be drawn into the pump 76 through the supply conduit 74 and exhausted through the atmospheric port 86. On the other hand, if the valve mechanism is set to supply positive air pressure to the table, air will be drawn into the pump 76 through the atmospheric port 86 and discharged at an above atmospheric pressure into the supply conduit 74.

The manner in which the vacuum or pressurized air appearing in the supply conduit 74 is distributed to the supporting surface 24 may vary widely, but preferrably such distribution means are such that the vacuum is applied to only a selected portion of the support surface 24 which vacuumized portion includes the area located beneath the cutter head 48. That is, the vacuum distribution means is preferably such that as the X-carriage 28 moves longitudinally of the table 16 the portion of the work supporting surface 24 subjected to a vacuum is varied so that the vacuumized portion always underlies the cutter 48. Also, the construction of the distribution system is preferrably such that when positive air pressure appears in the supply conduit 74 a positive pressure appears over the entire extent of the support surface. In the illustrated case the distribution system is taken to be similar to that described and shown in my U.S. patent application filed conurrently herewith and titled "Apparatus with Belt Valve Vacuum System for Working on Work Material", which application is incorporated herein by reference and to which reference may be made for further details.

Figure 3:
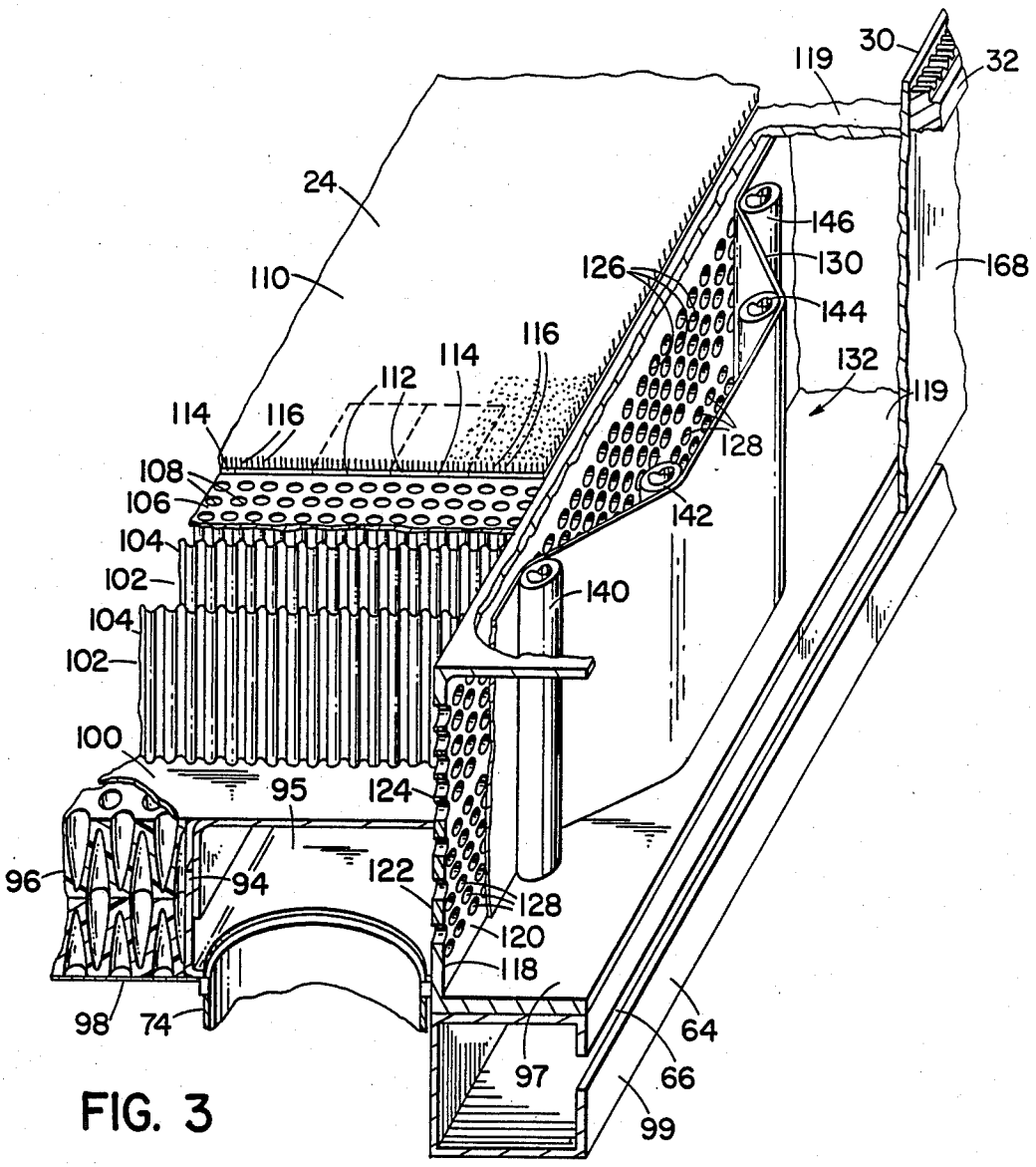
FIG. 3 is a fragmentary perspective view showing a portion of the cutting table of FIG. 1.
Figure 4:
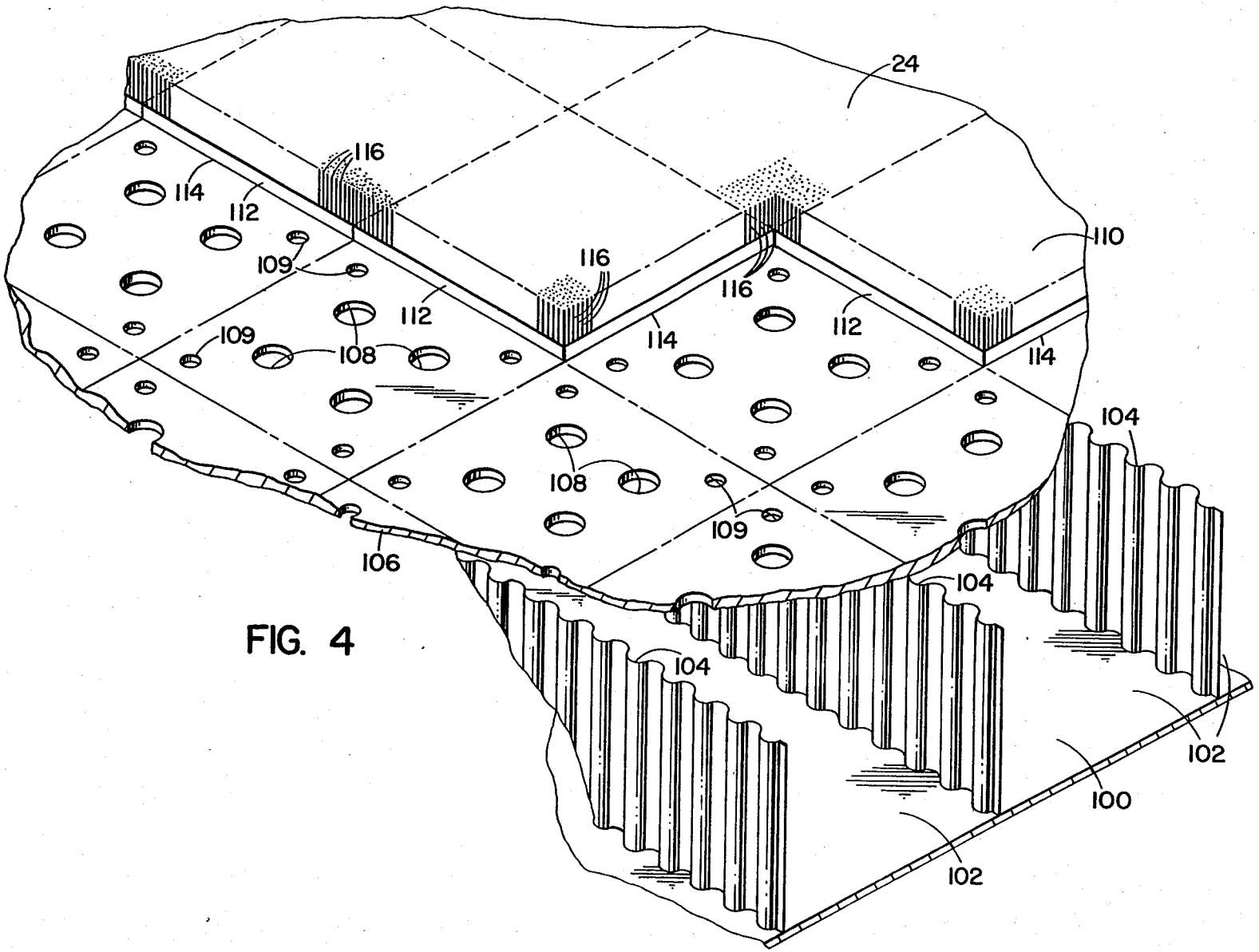
FIG. 4 is a fragmentary perspective view on a scale enlarged from that of FIG. 3 showing another portion of the cutting table of FIG. 1.

For the present it is sufficient to note, referring to FIGS. 3 and 4, that the framework of the table 16 includes, extending longitudinally along its right hand side as seen in FIG. 3, three members 94, 97 and 99, preferably made of aluminum, welded or otherwise joined to one another in the arrangement shown. The member 99 forms the cable housing 64. The member 94, in conjunction with part of the member 97, forms an air plenum 95 connected to the supply conduit 74. This member 94 and a somewhat similar longitudinally extending tubular member (not shown) extending along the opposite side of the table are located at the lower level of the table and between them is a rigid but lightweight base block made of a honeycomb body 96 sandwiched between two aluminum sheets 98 and 100. The top sheet 100 forms the bottom wall of a number of compartments 102, 102 separated from one another by partitions 104, 104 of corrugated aluminum sheet extending upwardly from the bottom sheet 100 and extending transversely of the table. The partitions are imperforate and extend all the way between the sides of the table so that each compartment 102 is closed against the ingress or egress of air except through its top portion and its right hand end portion. The spacing between the partitions longitudinally of the table may vary, but in the illustrated case such spacing is taken to be two inches, thereby making each compartment 102 two inches wide.

The partitions 104, 104 in addition to defining the compartments 102, 102 also act as supports for supporting the components of the supporting surface 24. As seen in FIGS. 3 and 4 these components include a rigid metal base 106 in the form of a sheet or plate, preferrably of aluminum, resting directly on the upper sides of the partitions 104, 104 and having a large number of apertures 108, 108 evenly distributed over its entire extent, and also having a number of smaller apertures 109, 109 also regularly distributed over its entire extent. The base plate 106 supports the bristle bed 110, the upper ends of the bristles of which define the support surface 24. This bed is made up of a plurality of individual bristle blocks 112, 112, of square shape in plan view, fitted adjacent to one another to make up the overall bed. The exact structure of each bristle block is described in more detail hereinafter, but for the moment it may be noted that each block has a base layer 114 containing apertures 113, 113 (as seen for example in FIG. 8) to allow air to pass vertically therethrough and which base layer carries a large number of bristles 116, 116 which extend vertically upwardly therefrom. Each bristle block is secured to the base plate 106 by having four downwardly extending posts 115, 115 which snap into the complementarily shaped and arranged openings 109, 109 in the base 106. Therefore, if the bristles of one or more blocks become damaged those blocks may be replaced by new ones without having to replace the entire bristle bed 110.

The apertures 108, 108 in the base plate 106 and the apertures 113, 113 in the bases 114, 114 of the bristle blocks allow air to pass between the support surface 24 and each underlying compartment 102. Therefore, when vacuum is applied to any one compartment 102, that vacuum is transmitted directly through the top of the compartment and through the overlying space containing the bristles 116, 116, to the portion or area of the support surface 24 directly overlying that compartment, with some of the vacuum also spreading out longitudinally of the table through the bristle containing space of the bristle bed. Similarly, if a positive air pressure is applied to a compartment, such positive pressure is also transmitted through the base plate 106 and bristle bed 110 to cause a positive pressure to appear over that portion of the work supporting surface 24 overlying that compartment. As explained hereinafter, however, the structure is such as to provide many individual air conditioning paths between each compartment and associated individual small areas of the work supporting surface, and each of these paths preferably is designed to offer some resistance to the flow of air therethrough at high rates so that a portion of the work surface above a compartment may be left uncovered without thereby entirely losing vacuum in that compartment or the related ability to supply vacuum to the remaining portion of the work surface above that compartment.

The compartments 102, 102 are selectively vacuumized in the illustrated case by means of a simple belt valve mechanism located along the right side of the table cooperating with the air plenum 95 and with the adjacent ends of the various compartments 102, 102. The frame member 97 has a web 118 and two horizontal flanges 119, 119 with the web 118 constituting a valving member having a valving face 120. This valving member 118 is located in a vertical plane and has a lower longitudinally extending portion 122 aligned with the member 94 and forming the right hand wall of the air plenum 95. Another, upper longitudinally extending portion 124 of the valving member 118 is aligned with the right hand ends of the compartments 102, 102 and forms the right hand end walls of such compartments. A large number of holes extending through the valving member 118 are provided in each of the longitudinally extending portions 122, 124 of the valving member. The holes in the upper longitudinally extending portion 124 extend through the valving member to provide a series of first ports 126 on the valving face 120, and the holes in the bottom longitudinal portion 122 extend through the valving member to provide a series of second ports 128 on the valving face 120, there being at least one port 126 and one port 128 in the valving face 120 for each compartment 102.

Cooperating with the valving face 120 of the valving member 118 is an air impermeable belt 130 and a belt deflector unit 132. The belt 130 extends along the entire length of the valving member 118 while the belt deflector unit has a total length equal to the length of only a small number of side by side compartments 102, 102.

The belt deflector unit 132 is shown only schematically in FIG. 3 and as there shown includes four rollers 140, 142, 144 and 146 which at the location of the belt deflector unit 132 deflect the belt 130 away from the valving face 120 of the valving member 118. The four rollers 140, 142, 144 and 146 are supported from a common member (not shown) for movement in unison along the length of the valving member 118 and such movement is coordinated with the movement of the X-carriage 28 so that the belt deflector unit 132 is positioned at the same longitudinal location along the length of the table as is the cutter head 48 carried by the X-carriage 28. On opposite sides of the deflector unit 132, the belt 130 is positioned against the valving face 120 and seals the associated first and second ports 126 and 128 from one another to thereby prevent the vacuum from being transmitted from the plenum 95 to the associated compartments 102, 102. At the location of the belt deflector unit 132, however, the belt is held by the rollers 140, 142, 144 and 146 away from the valving face 120 to provide communication between those first and second ports 126 and 128 adjacent the deflector unit thereby causing an associated few of the compartments 102, 102 to be supplied with vacuum. The number of compartments vacuumized depends on the length of the deflected portion of the belt with such length in the illustrated case being one causing essentially five compartments 102, 102 to be vacuumized at one time.

The outboard open face of the member 97 is closed by a cover plate 168 the upper portion of which forms the right hand wall 30. The member 97 and the cover plate 168 therefore define an elongated closed chamber for receiving the deflector unit 132 with such chamber also being closed at the opposite longitudinal ends of the member 97. Therefore, if pressurized air is supplied to the air plenum 95 air at this pressure will pass through the ports 128 in the lower portion of the valving member 118 and push the belt 130 away from the valving face along the extent of such face 120 located on opposite sides of the deflector unit. Thus, air at the positive pressure will be free to flow from the ports 128, 128 to the ports 126, 126 along the full extent of the valving member 118, providing positive air pressure to all of the compartments 102, 102 and thereby in turn providing positive air pressure over the entire extent of the supporting surface 24.

In keeping with the invention the bristle bed 110 is made in such a way that the ends of the bristles forming the support surface 24, instead of being blunt or flat topped as in the prior art, are pointed so that when a sheet of penetrable material is spread onto the support surface the pointed bristle ends penetrate the sheet at least to some extent to inhibit movement of the sheet in the plane of the support surface. Also, the bristles are of such lengths and shapes, are made of such material and are so densely packed as to be relatively stiff and resistent to the bending of their upper ends in reaction to forces appearing in the plane of the support surface. The bristles are also so shaped that the cut sheet material can be readily lifted from the support surface after cutting. Further, the bristle bed 110 presents a substantial resistance to the flow of air through the bed longitudinally of the table so that when a selected group of compartments 102, 102 are vacuumized the degree of vacuum appearing at the support surface 24 diminishes gradually longitudinally of the table with distance from the adjacent vacuumized compartment.

Figure 6:
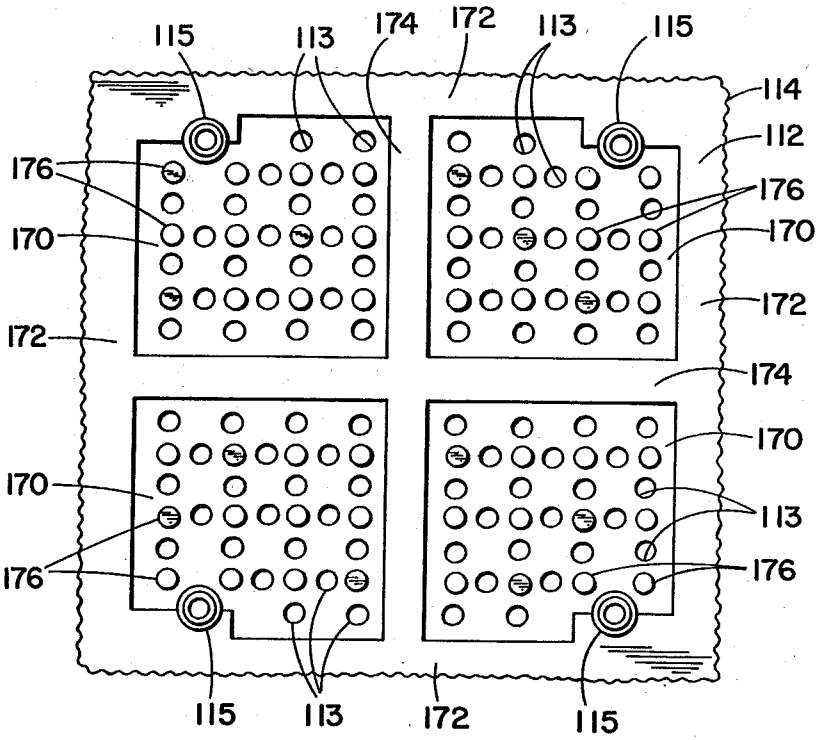
FIG. 6 is a bottom view of the bristle block of FIG. 5.
Figure 5:
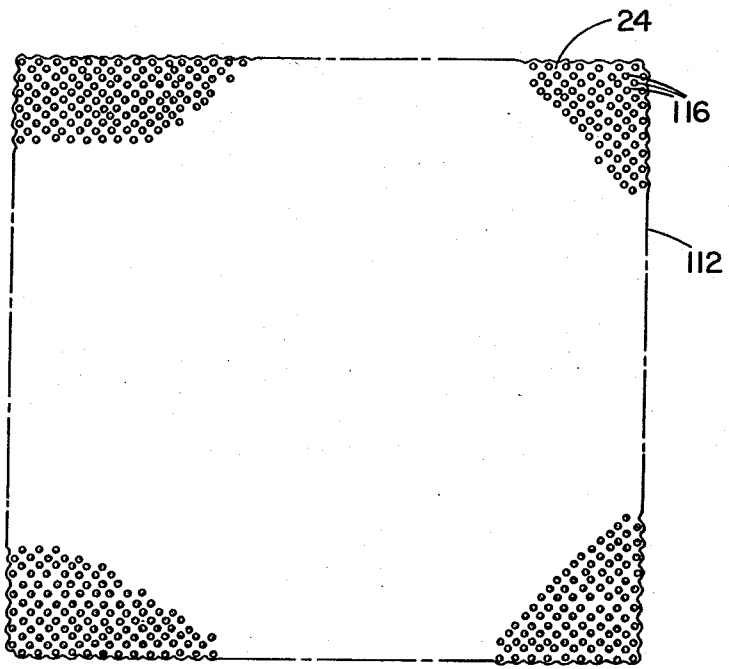
FIG. 5 is a plan view of one of the bristle blocks used in forming the bristle bed of the cutting machine of FIG. 1.
Figure 7:
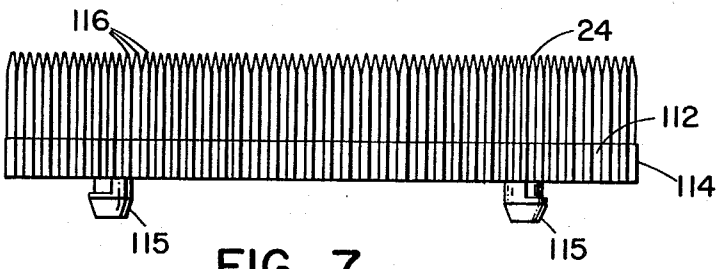
FIG. 7 is a side elevational view of the bristle block of FIG. 5.
Figure 8:
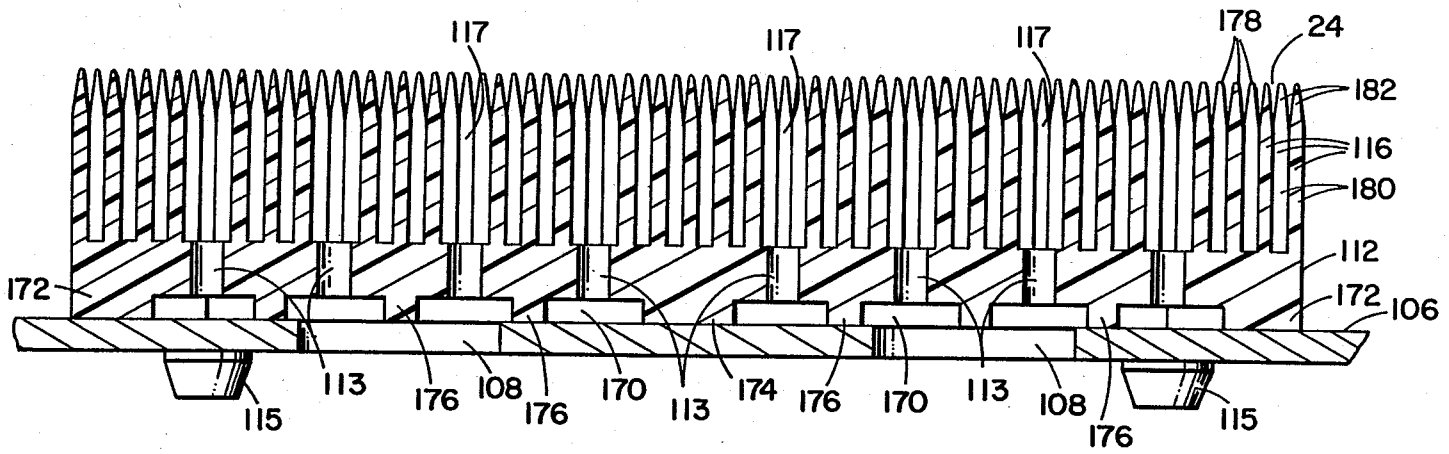
FIG. 8 is an enlarged transverse sectional view taken on the line 8—8 of FIG. 5.

Reference may now be made to FIGS. 5 to 10 for a detailed description of a bristle block 112 made in accordance with the invention. As shown by these figures the bristle block 112 is an injection molded plastic part wherein the base 114, the bristles 116, 116 and the four attachment posts 115, 115 are integral with one another. Various different plastics or other materials may be used for making these bristle blocks but nylon and polypropylene are presently preferred materials. As previously mentioned, in plan view each block 114 is of square shape and measures two inches along each side. The base 114 is approximately one-eighth inch thick. As seen in FIG. 6 the bottom surface of the base includes four generally square recessed areas 170, 170 defined by four peripheral ribs 172, 172 and two interior intersecting ribs 174, 174. Within each recessed area 170 are twelve projections 176, 176 and twenty-two apertures 113, 113. As shown in FIG. 8 when a bristle block 112 has its four attachment posts 115, 115 snapped into the support plate 106 the peripheral ribs 172, 172 the interior ribs 174, 174 and the projections 176, 176 (except for such projections 176, 176 as may be located above holes 108, 108 in the plate 106) engage the upper surface of the plate 106 to provide firm vertical support for the bristle block. Further, with the bristle block 112 so assembled to the support plate 106 one hole 108 in the support plate underlies each recess 170 with the recess 170 allowing free air flow between its associated hole 108 and the associated apertures 113, 113 extending through the base 114.

Figure 10:
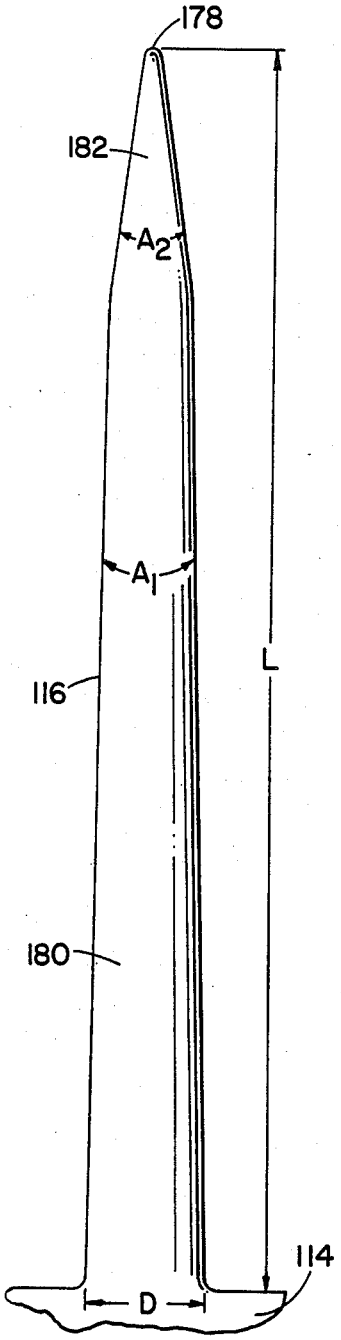
FIG. 10 is a greatly enlarged side elevational view showing the shape of one of the bristles of the bristle block of FIG. 5.

The bristles 116, 116 extend upwardly from the base 114 and at their upper ends have end portions which diminish smoothly in cross sectional area to relatively sharp points 178, 178 located in a common horizontal plane to thereby define and provide the supporting surface 24. The particular shape employed for each bristle 116 and the manner in which its point 178 is formed may vary, but in the illustrated case, as best shown by FIG. 10, each bristle 116 is of generally circular cross section and has a lower portion 180 and an upper portion 182. The upper portion 182 occupies about one-fifth to one-fourth the total length L of the bristle with the bottom portion 180 occupying the remainder of the bristle length. The lower portion 180 is substantially a right circular cylinder having only a slight taper sufficient to facilitate removal of the bristle block from its mold in the injection molding process, the illustrated angle $A_1$ of FIG. 10 being typically one degree. The upper portion 182 is conical in shape and has a cone angle $A_2$ sufficient to make the upper portion 182 along with its point 178 easily penetrable into penetrable sheet material spread onto the support surface 24. Preferably, the cone angle A2 is less than thirty degrees, and in the illustrated case is about sixteen degrees. The bristles 116, 116 are of relatively short length in relation to their other dimensions so as to be relatively stiff. For example, the bristles are preferrably less than one-half inch long and at their lower ends adjacent the base 114 have a diameter D of more than 0.020 inches. The aspect ratio (L/D) of each bristle is therefore twenty-five or less. The bristles are also preferrably packed to a density of more than 500 bristles per square inch. In the illustrated embodiment of the invention the bristles are approximately 0.300 inches long, have diameters at their lower ends of about 0.026 inches and are packed to a density of about 700 bristles per square inch. Also, the point 178 on the upper end of each bristle is relatively sharp. In the illustrated case, this point is shown to be generally rounded, but it may also be flat or of some other shape. In the illustrated case, the radius of the rounded point is in the order 0.008 inches, and if the point is of a flatter shape the diameter of the flat area is typically 0.016 inch or less.

Figure 9:
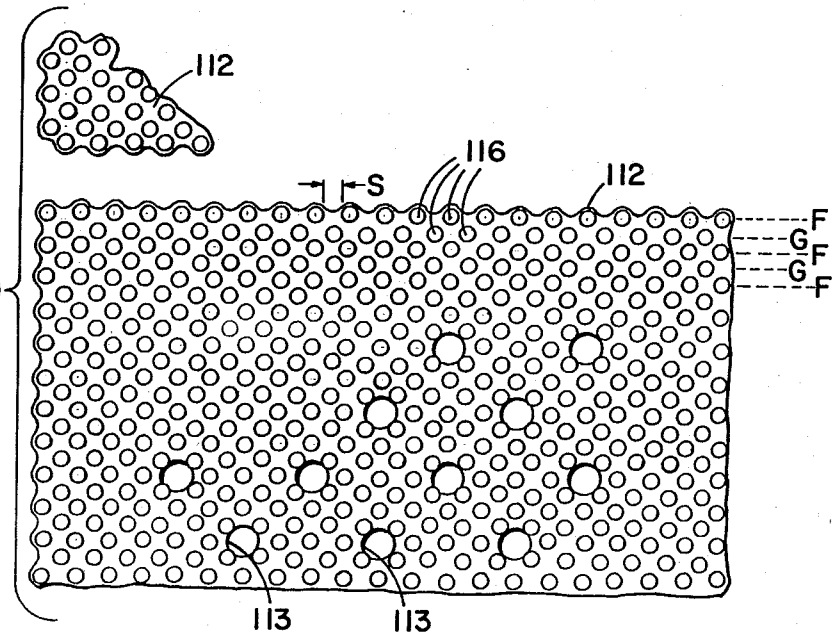
FIG. 9 is an enlarged fragmentary plan view of two adjacent bristle blocks of the bristle bed of the machine of FIG. 1 with the two bristle blocks being shown slightly spaced from one another.

The arrangement of the bristles 116, 116 in the illustrated bristle block 112 is shown most clearly in FIG. 9. Referring to this figure, the bristles 116, 116 in each bristle block 112 are arranged in staggered alternate rows F and G, there being thirty-eight rows F and thirty-eight rows G in each bristle block, with each row F and each row G containing thirty-eight bristles, except that one bristle is missing at the location of each aperture 113. Since there are eighty-eight apertures 113, 113 in each bristle block, each bristle block contains 2,800 bristles, or 700 bristles per square inch. Further, in each row F and G the bristles 116, 116 at their lower ends are separated from one another by spaces S approximately equal to the diameter of each bristle. Accordingly, the diameter D of each bristle at its lower end is approximately 0.026 inches and the spacing S between each pair of bristles in each row F and G is approximately 0.026 inches. Each aperture has a diameter of about 0.060 inches. Still further, as evident from FIG. 9, the side edges of each bristle block 112 are profiled so that the edges of adjacent blocks will nest closely with one another with the spacing and arrangement of the bristles continuing regularly and uniformly from one bristle block to the next to provide the bristle bed 110 with a uniform quality over the entire extent of its supporting surface 24.

Figure 11:
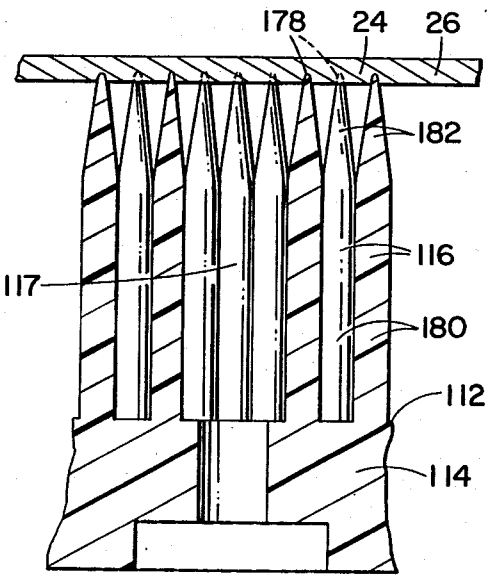
FIG. 11 is an enlarged fragment of FIG. 8 showing the way in which the pointed ends of the bristles engage a sheet of material spread thereon.

A bristle bed 110 made of bristle blocks as described above supports a sheet of penetrable material 26 spread on the supporting surface, as illustrated in FIG. 11, by the pointed upper ends 182, 182 of the bristles 116, 116 penetrating to some extent into the material 26 to prevent the material from freely sliding over the support surface 24, yet the fact that the upper ends 182, 182 of the bristles smoothly taper to the points 178, 178 allows the material 26 to be readily removed from the support surface 24 by merely lifting it upwardly from the support surface.

Generally speaking, when the bristle bed 112 is used to support a sheet of sheet material, such as the sheet 26, without the assistance of a vacuum applied to the space containing the bristles 116, 116, the degree to which the pointed upper ends of the bristles will penetrate the sheet 26 depends on the nature of the sheet material. That is, if the sheet is a loosely woven material the pointed ends of the bristles will tend to penetrate the sheet to a greater degree than if the sheet is a hard tightly woven one. An important aspect of the invention is, however, that when a vacuum is applied to the bristle containing space the holding effect of the bristles relative to the sheet material is normalized so as to be substantially equal, or at least more equal, for different types of material. For example, if the sheet material 26 is a soft loosely woven one its resistance to the flow of air therethrough will be small, whereas if the sheet 26 is a sheet of hard tightly woven material it will offer substantial resistance to the flow of air therethrough. Thus, if a sheet of soft loosely woven material is spread on the support surface and a vacuum is created in the bristle containing space the vacuum will tend to draw the material onto the pointed ends of the bristles only a small amount farther than if the vacuum were not used. On the other hand, if a sheet of hard tightly woven material is spread onto the supporting surface and the bristle space is vacuumized, the vacuum will tend to draw the material onto the bristles substantially farther than if no vacuum were used. Therefore, through the use of the vacuum both materials tend to become penetrated by or held to the bristles to somewhat the same degree despite their differing characteristics.

The low vertical heigth of the bristles 116, 116, their thickness, and the density to which they are packed in the bed 110 also has the effect that they cumulatively provide a substantial resistance to the flow of air through the bristle bed, that is through the space containing the bristles, in a plane parallel to the support surface. Therefore, if the support surface 24 is entirely, or substantially entirely, covered with a sheet 26 of material to be cut offering some resistance to the flow of air therethrough, and a vacuum is supplied to only a selected group of compartments 102, 102 in the manner described above, the area of the work supporting surface directly above the vacuumized compartments will have a substantially uniform degree of vacuum appearing over it. Due to the flow of air through the bristle bed longitudinally of the table on either side of the vacuumized compartments some vacuum will also appear at the work surface on either side of the area directly overlying the vacuumized compartments, but because of the resistance offered by the bed the vacuum over these areas will diminish with distance from the adjacent vacuumized compartment. As a consequence of this it will be understood that when a group of compartments are vacuumized the vacuum applied to the material spread on the supporting surface will, in going longtitudinally in one direction of the support surface, gradually increase to the maximum value appearing at the area directly over the vacuumized compartments and will then gradually diminish in proceeding away from the vacuumized compartments, the vacuum thereby being unlikely to produce any waves or other disturbances in the material tending to shift it relative to the support surface in the plane of that surface.

The resistance of the bristles to the flow of air through the bristle containing space in planes parallel to the support surface, also cooperates with the resistance to air flow provided by the apertures 113, 113 and with the arrangement of the bristles 116, 116 surrounding each aperture 113 to provide other benefits. That is, each aperture 113, as seen in FIGS. 9 and 11, has a bristle omitted from the bristle block at its location so that four other bristles surround it and extend upwardly from its upper edge to form a bristle free funnel-like continuation 117 of the aperture 113 extending from the base 114 to the support surface 24. Therefore, the vacuum appearing in the aperture 113 is communicated directly to the overlying small area of the work surface and to the sheet 26 of material supported thereon. Some air will flow laterally into each of these spaces 117, but as mentioned, the bristles 116, 116 present some resistance to this flow. The apertures 113, 113 are further of such size, such as 0.060 inches in diameter, as to present a substantial resistance to the flow of air therethrough at high volumetric rates. Thus, if one compartment 102 is vacuumized and a portion of the work surface 24 located above it is not covered with a sheet of work material or a sheet of sealing material air will flow into the compartment through the uncovered parts of the surface 24, but the associated apertures 113, 113 will resist such flow sufficiently to allow a substantial degree of vacuum to remain in the compartment, thereby applying vacuum to the apertures 113, 113 and related portions of the work surface overlying those apertures as may be covered with work material. The accompanying fact that the bristles present some resistance to the flow of air in a plane parallel to the support surface and the fact that the spaces 117, 117 conduct the vacuum appearing in apertures 113, 113 directly to overlying work material inhibits diversion of the vacuum appearing in the apertures 113, 113 to the uncovered portion of the support surface and instead assures that a substantial degree of vacuum will be applied to the work material.

It should be understood, however, that means other than the apertures 113, 113 may be used to provide a resistance to air flow between each compartment and the overlying bristle containing space. For example, the holes 108, 108 in the sheet 106 might be sized to provide the restriction. Also, instead of apertures 113, 113 in the bristle blocks, the bristle blocks may be spaced slightly from one another to define perimetral gaps for air flow and such gaps may be sized to provide the desired restriction.

In some instances the mere weight of the sheet 26 spread on the bristle bed 110 is enough to achieve a penetration of the pointed upper ends of the bristles into the sheet to a degree sufficient to obtain a desired amount of holding effect. As mentioned above, in cases where additional holding effect is desired, vacuum may be applied to the bristle space to add another force drawing the sheet onto the bristles. Also, an increased holding effect may be obtained by providing a means for mechanically pressing the sheet 26 downwardly onto the upper ends of the bristles after it is spread onto the supporting surface 24. Such means may take the form, for example, of a roller moveable over the sheet 26 after its placement on the supporting surface, a platen moveable downwardly onto the spread sheet 26 or a tamper moveable over the spread sheet for progressively tamping it onto the pointed bristle ends.

Figure 2:
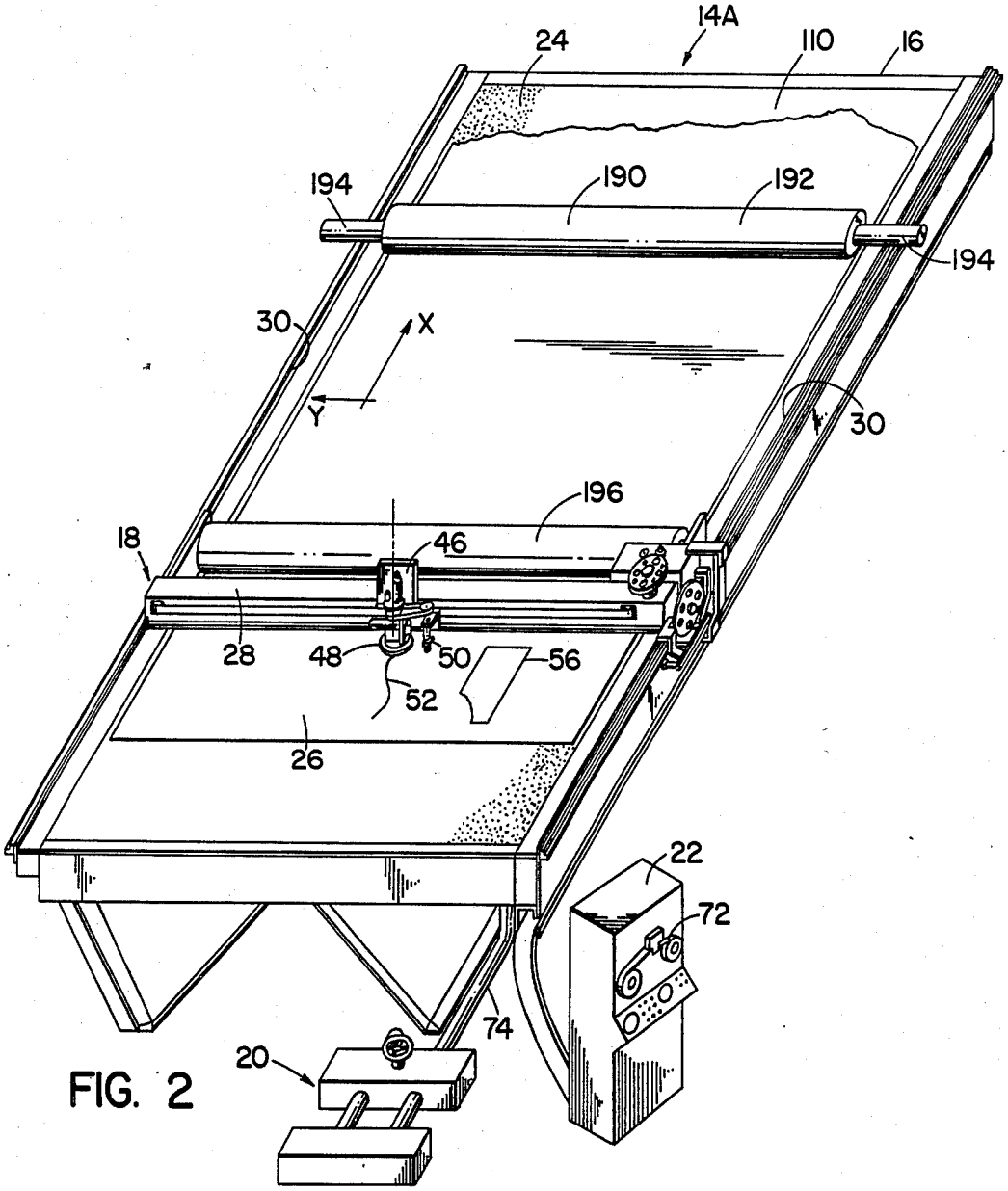
FIG. 2 is a perspective view similar to FIG. 1 but showing a cloth cqtting machine comprising a slightly different embodiment of the invention.

FIG. 2 by way of example shows a cutting machine 14A which is identical to the machine 14 of FIG. 1 except for being equipped with two different forms of rollers for pressing a sheet 26 onto the pointed bristle ends of the bristle bed after the sheet is placed onto the supporting surface. One roller is a manually operable one 190 having a roll 192 and two handles 194, 194. Preferrably the roll 192 has an outer portion made of foam rubber or the like giving it a somewhat resilient roll surface. In use, the roller 192 is applied to the table 16 in the manner shown in FIG. 2, after the sheet 26 is positioned on the supporting surface 24, and is then moved longitudinally of the table by two operators each grasping one handle 194. The roller may be weighted so that as it is moved over the sheet 26 its weight alone is sufficient to produce the desired amount of downward force to be applied to the sheet 26. Of course, the operators may also control the force applied to the sheet by pressing down on or lifting up on the handles 194 as the roll is moved longitudinally of the table. After the use of the roll 192 to press the sheet onto the bristles it is removed from the table before the cutting operation begins.

As an alternative to the manually operable roller 190 the machine 14A may have a roller 196 carried by the X-carriage 28. The roller 196 preferrably has an outer portion made of foam rubber or similar material to give it a somewhat resilient roll surface. A means (not shown) carried by the X-carriage 28 raises and lowers the roller relative to the work surface 24 and also possibly controls the degree of downward force applied by the roller to the spread sheet 26. In use, after the sheet 26 is placed onto the support surface 24 the X-carriage 28 is moved to one end of the table, the roller 196 is lowered onto the sheet 26 and then the roller is moved over the spread sheet by moving the carriage 28 longitudinally, or in the X-coordinate direction, over the full length of the sheet. The roller is then raised from the sheet and the X-carriage 28 used as part of the apparatus for cutting the sheet.

Figure 13:
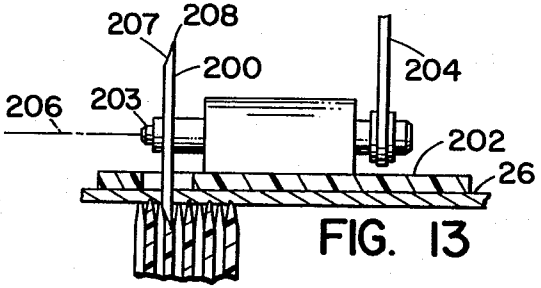
FIG. 13 is a front view of the cutting tool of the cutting tool taken generally on the line 13—13 of FIG. 12.
Figure 12:
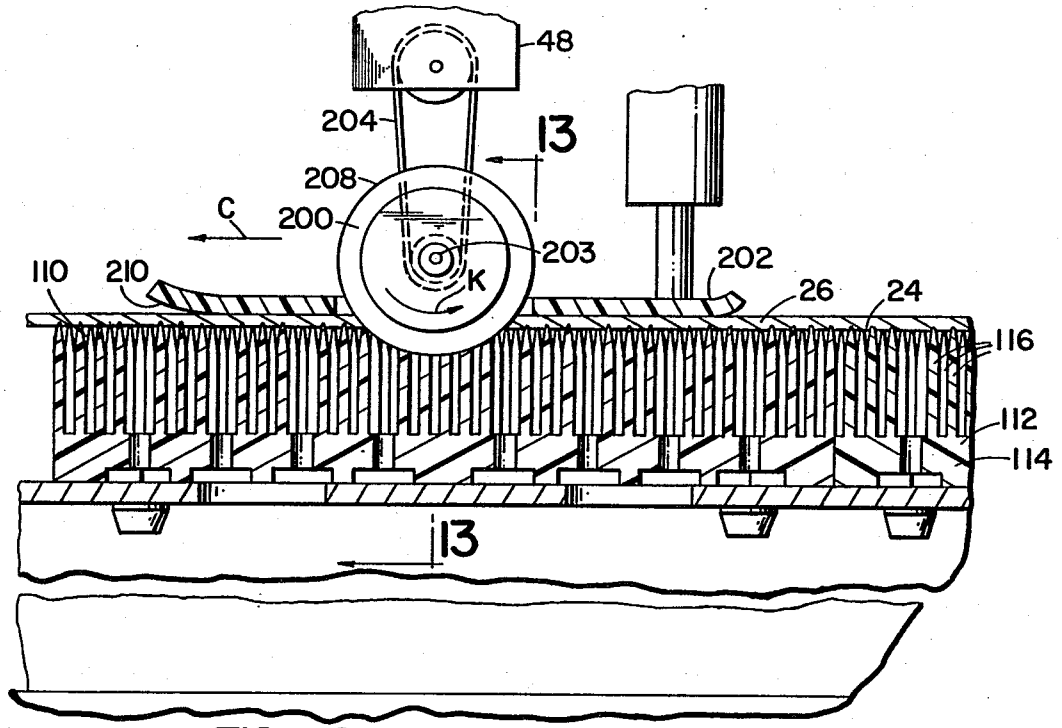
FIG. 12 is a fragmentary sectional view taken through the bristle bed of the machine of FIG. 1 in the vicinity of the cutter showing the cooperation of the bristle bed, sheet material being cut and cutting tool.

Various different forms of cutters including manually guided ones may be used with the bristle bed 110 for cutting pattern pieces from sheet material spread thereon. In the machine 14 of FIG. 1, and in accordance with some aspects of the invention, the cutter 48 is one using a small, thin, high speed rotary cutter blade 200 as shown in FIGS. 12 and 13. The blade 200 is supported on a shaft 203 rotatably supported on a presser foot 202 and driven by a belt 204 from a motor (not shown) located above the blade, the shaft 203 being rotatable about an axis 206 generally parallel to the support surface 24. The blade 200 is supported, as shown in FIGS. 12 and 13, so that a segment shaped area of it extends into the bristle bed 110 by a radial distance less than one-fourth the diameter of the blade, and at least the outer annular portion of the blade which passes through the bed 110 has a maximum thickness of 0.010 inch. In the illustrated embodiment of the invention where each bristle block 112 of the bristle bed 110 has a base 114 one-eighth inch thick and bristles 0.300 inches long, the blade 200 is comprised of a flat disk of about three-fourths of an inch diameter having a maximum thickness of about 0.050 inches, its outer annular zone, as indicated at 207, being beveled on one side to provide a sharp circumferential cutting edge 208, the bevel 207 being convex and extending radially of the blade 200 for a distance of about one-eighth to three-sixteenth inch. Therefore, only a very thin small portion of the blade extends into the bristle bed and is readily accommodated by the bristles. Although the blade has been shown beveled on one side only it could, if desired, be beveled on both sides.

The general direction of the cutter movement in following a line of cut is indicated by the arrow C in FIG. 12, and the direction of rotation of the cutter blade 200 is indicated by the arrow K. The presser foot 202 also may exert a downward force onto the sheet 26 to aid in pressing that sheet onto the pointed ends of the bristles 116 in the immediate vicinity of the cut made by the blade 200. That is, the weight of the cutter 48 may be vertically supported by the engagement of the presser foot 202 with the sheet 26 spread on the bristle bed, or some other means may be provided in the cutter for urging the presser foot 202 downwardly onto the sheet with some amount of controlled force. The presser foot 202 has an undersurface 210 which engages the sheet 26 and slides over it during a cutting procedure. To reduce the friction between the presser foot and the sheet 26, this surface 210 is preferrably made of a low friction material such as tetrafluroethylene.

As the cutter head 48 moves forwardly in the direction of the arrow C along a line of cut the rotary cutter blade exerts some forwardly directed force onto the sheet 26 and also the presser foot 202, by friction, exerts another forwardly directed force on the sheet 26. Because of its indicated direction of rotation, however, the cutter blade tends to pull the sheet 26 in a rearward direction thereby exerting a rearward force on the sheet opposing the mentioned forwardly directed forces. Accordingly, the resultant force on the sheet 26, appearing in the plane of the support surface 24 and which has to be resisted by the bristles 116, is reduced, thereby reducing possible accompanying bending of the bristles and movement of the sheet 26.

Instead of being rotated in the direction of the arrow K as illustrated in FIG. 12, the blade 200 may also be rotated in the opposite direction if, desired. This has the effect that the blade in cutting exerts a force on the sheet material 26 urging it upwardly against the undersurface 210 of the presser foot 202, which may be preferable for the cutting of some material.

The speed of the blade 200 may vary but preferrably is greater than 15,000 revolutions per minute as such high speed has been found to produce a very desirable quality and accuracy of cut. The blade may be made of various materials such as steel. In some cases a low friction blade may be desirable and such blade may be made of or may be covered with a low friction material such as polyonal (a combination of electroless nickel and tetrafluroethylene).

A further way of additionally urging the spread sheet 26 downwardly onto the pointed bristles of the bristle bed is to direct a flow of pressurized air downwardly onto the sheet. The construction of the bristle bed 110 as described above lends itself well to such downward force applying means since it allows the air after passing through the sheet 26 to escape by passing through the bristle containing space. Therefore the air flow has little or no disturbing effect on the sheet. This is in contrast to the case where the sheet 26 might be spread on a solid non-airconducting supporting surface. If air is directed downwardly onto a sheet spread on such a surface the air after striking the sheet has no escape route except to flow laterally over the supporting surface between it and the sheet, or over the top of the sheet, and such flow may have a tendency to flutter or otherwise displace the sheet relative to the supporting surface with undesirable effects on cutting accuracy.

Figure 14:
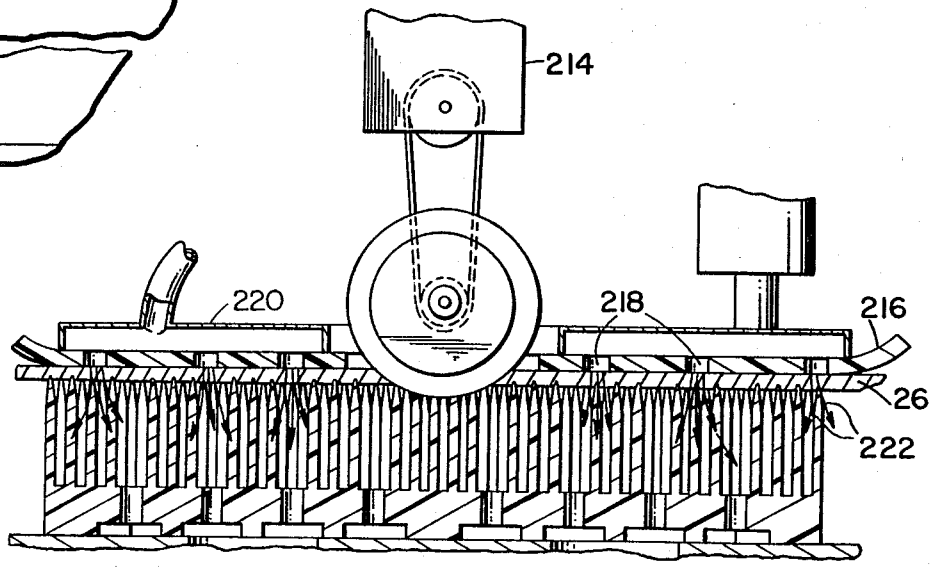
FIG. 14 is a view similar to FIG. 12 but shows an alternate embodiment of the invention.

A downwardly directed flow of air to aid in holding a sheet 26 to the bristle bed 110 of the invention may be applied in many different ways, one of which is shown for example in the cutter 214 illustrated by FIG. 14. This cutter 214 is substantially similar to the cutter 48 of FIGS. 12 and 13 accept that the presser foot 202 of FIG. 12 is replaced by a presser foot 216 having a number of air ports 218 passing therethrough and communicating with a pressurized air plenum 220 for causing jets of downward directed pressurized air to be emitted from the under surface of the presser foot 216, the flow of such air being indicated by the arrows 222, 222.

The cutting machine 214 described above is not only useful for cutting single sheets of sheet material spread onto the support surface 24 of the bristle bed 110 but may also be used to cut layups consisting of two or more sheets of material spread on top of one another. If such a layup consists of only two or a few sheets of material such layups may in many cases be cut satisfactorily without covering the layup with a sheet of air impermeable material to produce a strong vacuum hold down effect in conjunction with a vacuum applied to the bristle containing space of the bristle bed. That is, the natural fuzziness or other surface characteristics of the sheets often produce sufficient friction between superimposed sheets to hold the sheets from slipping relative to one another during the cutting procedure. Also, if a vacuum is applied to the bristle containing space during the cutting procedure some pressure gradient will appear across each sheet of a low layup to enhance somewhat the friction or holding effect between superimposed sheets. Positive air pressure as applied, for example, by the presser foot 216 of FIG. 14 will also, if used, produce additional pressure gradient to enhance the holding effect between superimposed sheets.

However, if the layup becomes too high, or if for some other reason sufficient resistance to sliding between superimposed is not otherwise obtained, the machine of the invention may also be used with a layer of air impermeable material covering the layup and working with a vacuum in the bristle containing space in accordance with the basic vacuum compression principle described in U.S. Pat. No. 3,495,492.

Figure 15:
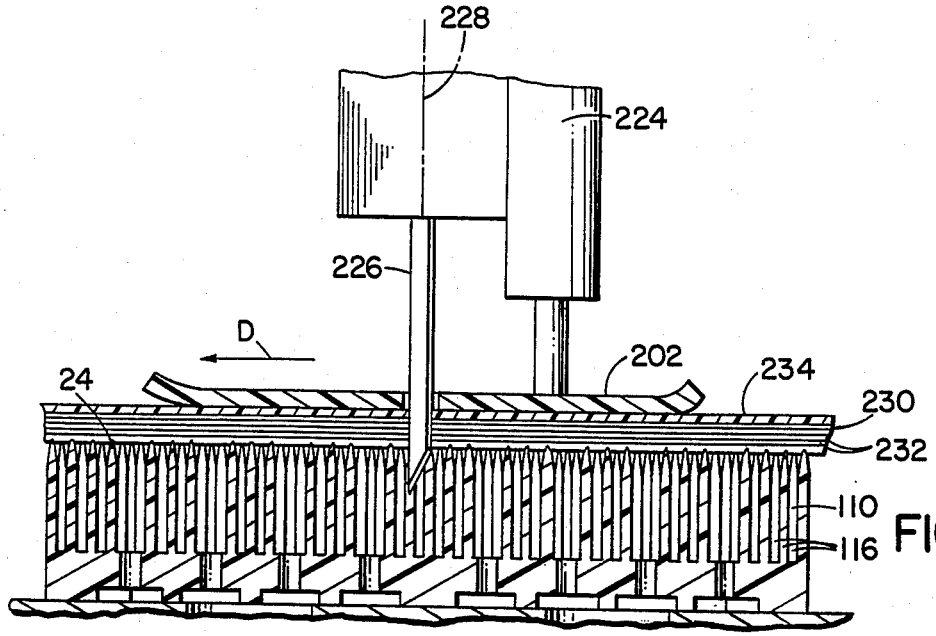
FIG. 15 is a view similar to FIG. 12 but showing yet another embodiment of the invention.

If a relatively high layup is to be cut it also may be desirable to use a cutter with a reciprocating blade in place of the rotary blade cutter 48, although the use of such reciprocating blade cutter is not limited to the cutting of high layups and may also be used in cooperation with a bristle bed embodying the invention for cutting single layers of sheet material or for cutting low layups consisting of only a small layer of superimposed sheets. By way of example, FIG. 15 shows the bristle bed 110 of the invention cooperating with a cutter 224 having a reciprocating cutter blade 226 reciprocable along a vertical axis 228 as the cutter is moved forwardly in the direction D along a desired line of cut. In this case the illustrated material being cut consists of a layup 230 comprised of a number of sheets 232 of air permeable sheet material and an overlying sheet 234 of air impermeable sheet material. During the cutting of the layup with the cutter 224 a vacuum is applied to the space containing the bristles 116, 116 with the result that the air impermeable sheet 234 is drawn downwardly toward the supporting surface 24 of the bristle bed 110 compressing the sheet 232 and holding the sheets of the layup rigidily relative to one another, and to the supporting surface 24, to prevent them from sliding relative to one another and to the supporting surface in planes parallel to the supporting surface.

Figure 16:
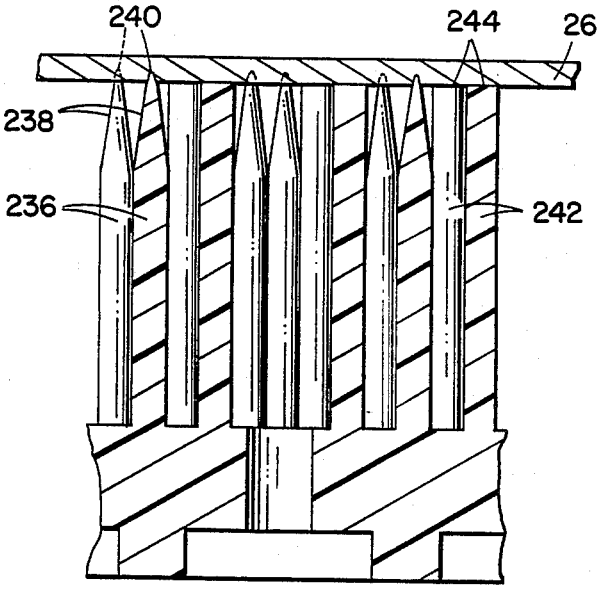
FIG. 16 is a view similar to FIG. 11 but showing an alternate embodiment of the invention.

FIG. 16 shows an alternative form of bristle bed which may be used in place of the bristle bed 110, particularly in cases where it is desired to accurately control the degree to which a sheet 26 spread onto the supporting surface of the bed is capable of moving downwardly onto the pointed bristles. The illustrated bristle bed of FIG. 16 is identical to the bed 110 previously described except that not all of the bristles of the bed have pointed upper ends. Instead, only some bristles 236, 236 are identical to the bristles 116, 116 of the bristle bed 110 and have pointed upper ends 238, 238 with points 240, 240. Other bristles 242, 242 have flat or blunt ends 244, 244 which are located a small distance below the plane containing the points 240, 240 of the pointed bristles. Therefore, when a sheet 26 is spread onto the supporting surface provided by the points 240, 240 of the bed of FIG. 16 the sheet after being penetrated to a certain extent by the pointed upper ends of the bristles 236, 236 will be held against further downward movement onto such pointed upper ends by engagement with the blunt upper ends 244, 244 of the other bristles 242, 242.

In the illustrated case the bristle bed of FIG. 16 is made exactly similarly to the bristle bed 110 described above except for having every other bristle of the bed be a flat topped bristle 242 rather than a pointed top bristle 236 with the flat topped bristles being uniformly interspersed with the pointed bristles. Further the flat tops 244, 244 of the bristles 242, 242 as illustrated are located between 0.010 inch and 0.040 inch below the points 240, 240 of the pointed bristles 236, 236.

Figure 20:
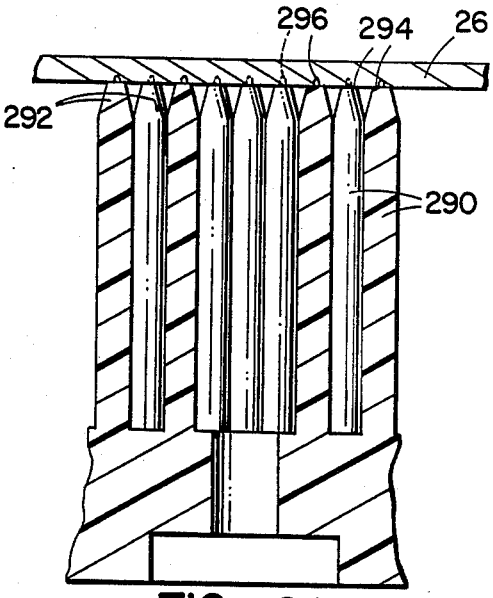
FIG. 20 is a view similar to FIG. 11 but showing still another embodiment of the invention.

An effect somewhat similar to that of the FIG. 16 bristle bed is achieved by that of FIG. 20. The bed of FIG. 20 is identical to the bed 110 described above except that each bristle 290, 290 instead of having a smoothly tapered upper end portion has an upper end portion 292 providing an upwardly facing plateau or surface 294 and a small pointed projection 296 extending upwardly for a short distance from the plateau. Therefore, when a sheet of penetrable material 26 is spread onto the bed of FIG. 20 the pointed projections 296, 296 on the upper ends of the bristles 290, 290 will penetrate into the material to inhibit lateral movement of the material and the plateaus 294, 294 will engage the undersurface of the material to limit its downward movement.

Figure 17:
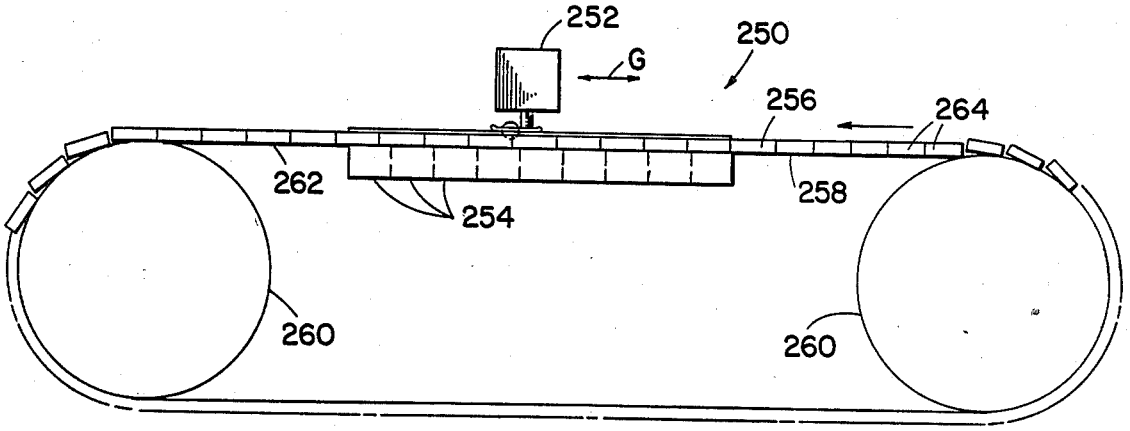
FIG. 17 is a somewhat schematic side view showing a cloth cutting machine comprising another embodiment of the invention.
Figure 18:
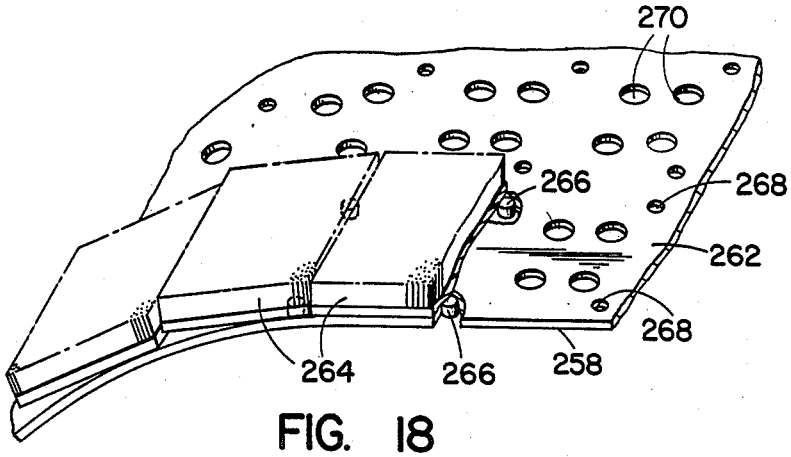
FIG. 18 is a fragmentary perspective view showing a portion of the conveyor belt of the machine of FIG. 16.

In the foregoing embodiments the bristle bed has been described in relation to a machine wherein the bristle bed is part of a stationary table so that the bed itself remains stationary at all times. Such construction is not, however, necessary to the broader aspects of the invention, and instead a bristle bed embodying the invention may as well be used with a cutting machine in which the bed moves, as part of a conveyor, relative to a cutting station as for example in U.S. Pat. No. 4,391,170. By way of illustration, such a moving bristle bed is shown schematically in FIGS. 17 and 18. The cutting machine 250 of these figures comprises an X and Y moveable cutter head 252 located at a cutting station having a plurality of stationary compartments 254, 254 underlying the cutter which may be selectively vacuumized in accordance with the movement of the cutter in the X-coordinate direction, indicated by the arrow G, in substantially the same way as described above for the table 16. The bristle bed 256 is part of an endless conveyor belt 258 moveable over the open tops of the compartments 254 and trained over wheels 260, 260. The conveyor belt 258 consists of a flexible metal band 262, or possibly a band made of articulated slats, generally equivalent, except for being moveable, to the support plate 106 of the bristle bed 110, and a plurality of bristle blocks 264, 264 attached to the support band 262 as shown in FIG. 18. The bristle blocks 264, 264 are identical to the bristle blocks 112, 112 of the bristle bed 110 previously described except that each block 264 is attached to the support band 262 in some way as to allow it to move slightly relative to the support band as the band passes over either one of the two wheels 260, 260, as illustrated in FIG. 17. As shown in FIG. 18, such support means for the bristle blocks 262, 262 comprises only two support posts 266, 266 located near the trailing edge of each bristle block snapped into complementary holes 268, 268 of the support band 262, the support band 262 also having other apertures 270, 270, equivalent to the apertures 108, 108 of the support plate 106, to allow air to flow between the support surface provided by the bristle blocks and the underlying compartments 254, 254 at the cutting station.

Figure 19F:
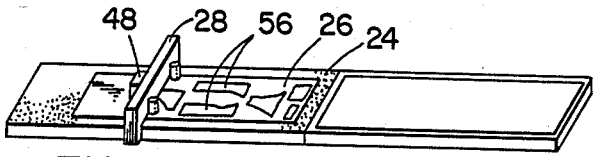
Figure 19G:
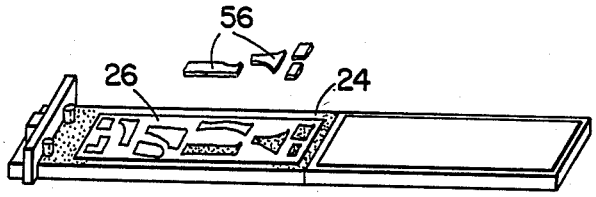

Having now described the apparatus of the invention, one method of using such apparatus will be described in connection with FIGS. 19*a* to 19*g*. Referring to these figures, as a first procedure a sheet 26 of penetrable sheet material is placed onto the supporting surface 24 of the cutting table 16. This may be accomplished in a number of different ways but in FIGS. 19*a* through 19*d* it is done by first, as shown in FIG. 19*a*, spreading the sheet 26 of penetrable material onto a sheet 280 of paper or similar impenetrable material on a spreading table 282 located adjacent one end of the table 16.

Then, as shown at FIG. 19*b*, the two sheets 26 and 280 are moved as a unit from the spreading table 282 onto the supporting surface 24 of the table 16. Next, as shown in FIG. 19*c* the sheet 26 is held relative to the table 16 and the sheet 280 is pulled out from under the sheet 26 to leave the sheet 26 deposited by itself onto the supporting surface, as shown in FIG. 19*d*.

Various different means may be used for holding the sheet 26 while the sheet 280 is pulled from under it, and in FIG. 19*c* such means are shown to comprise two clamps 283, 283 attached to the X-carriage 28 which are brought into holding relationship with the sheet 26 while the sheet 280 is pulled from under it. It should also be noted that during the step of moving the two sheets 26 and 280 onto the supporting surface 24 and/or during the pulling of the sheet 280 out from under the sheet 26 pressurized air may be applied to the bristle bed 110 in the manner previously described to aid in such movements.

After the sheet 26 is deposited onto the supporting surface 24 it may if desired, and as shown in FIG. 19*e*, be further pressed onto the pointed upper ends of the bristles of the bristle bed 110 by moving a roller, such as the illustrated roller 190, over the full length of the sheet 26, with the roller exerting a downwardly directed force onto the sheet during such movement. Further, vacuum may also now be applied to the bristle bed 110, if desired, to aid in holding the sheet 26 to the support surface.

The sheet 26 is next cut by the cutter head 48 to cut pattern pieces 56 from the sheet, as shown in FIG. 19*f*. Then, after the cutting is completed, the pattern pieces may be lifted from the support surface 24. In this lifting process the smoothly tapered shapes of the upper ends of the bristles allow the removal of the pattern pieces, as well as of the waste material, from the supporting surface without hinderance. Furthermore, during this removal of the pattern pieces and waste material from the supporting surface pressurized air may be applied to the bristle bed 110 to assist such removal.

I claim:

1. A method of cutting sheet material, which method comprises the steps of:

providing a bed formed by bristles having pointed upper ends the points of which are generally located in a common horizontal plane and form a support surface, said bristles each having a length (L) and having an upper end portion of a length equal to or less than one-forth of said length (L) of the bristle and a lower portion of a length equal to or more than three-fourths of said length (L) of the bristle, said lower portion being of substantially constant cross-section along its length and said upper end portion being shaped to provide a pointed upper end, placing a sheet of penetrable sheet material on said support surface so that said sheet becomes disposed in spread condition on said support surface with said pointed upper ends of said bristles penetrating said sheet at least to some extent to inhibit movement of said sheet laterally of said bed, then cutting said sheet with a cutter blade while it is disposed on said supporting surface, providing a vacuum in at least part of the space containing said bristles so that the said vacuum draws sheet material spread on said support surface downwardly onto said pointed bristles, and maintaining a said vacuum while said sheet is cut, said step of maintaining said vacuum while said sheet is cut being carried out in such a manner that said vacuum is maintained in only a selected portion of said space containing said bristles which selected portion includes and surrounds the point at which the cutting takes place.

2. A machine for cutting sheet material supported on a support surface in spread condition, said machine comprising a bed providing bristles having ends generally located in a common horizontal plane and forming a support surface for supporting sheet material in spread condition, the ends of at least some of said bristles which are located in said common plane being pointed so that when a sheet of penetrable sheet material is spread onto said support surface said pointed ends of said bristles penetrate said sheet at least to some extent to inhibit movement of said sheet in the plane of said support surface, said bristles with pointed ends each having a base end opposite its pointed end and a length (L) measured between its pointed end and its base end, each of said bristles with pointed ends having a first portion extending from its base end for a distance equal to at least three-fourths of said length (L) of the bristle and a second portion following said first portion which second portion has a length equal to one-fourth or less of said length (L) of the bristle and which second portion is shaped to define said pointed end of the bristle, said first portion of each bristle with a pointed end having a cross-section of substantially constant size and shape along its length, a cutter movable in two coordinate directions over and relative to said support surface for cutting sheet material spread on said support surface along a two-dimensional line of cut, said cutter including a cutter blade which in the process of cutting said sheet material passes through said sheet material and penetrates into said bed, and means for producing a vacuum in at least part of the space containing said bristles, said means for producing a vacuum in at least part of the space containing said bristles being a means for producing said vacuum in the space containing said bristles only over a selected area of said support surface.

3. A machine for cutting sheet material supported on a support surface in spread condition, said machine comprising a bed providing bristles having ends generally located in a common horizontal plane and forming a support surface for supporting sheet material in spread condition, the ends of at least some of said bristles which are located in said common plane being pointed so that when a sheet of penetrable sheet material is spread onto said support surface said pointed ends of said bristles penetrate said sheet at least to some extent to inhibit movement of said sheet in the plane of said support surface, said bristles with pointed ends each having a base end opposite its pointed end and a length (L) measured between its pointed end and its base end, each of said bristles with pointed ends having a first portion extending from its base end for a distance equal to at least three-fourths of said length (L) of the bristle and a second portion following said first portion which second portion has a length equal to one-fourth or less of said length (L) of the bristle and which second portion is shaped to define said pointed end of the bristle, said first portion of each bristle with a pointed end having a cross-section of substantially constant size and shape along its length, and a cutter movable in two coordinate directions over and relative to said support surface for cutting sheet material spread on said support surface along a two-dimensional line of cut, said cutter including a cutter blade which in the process of cutting said sheet material passes through said sheet material and penetrates into said bed, said bristles of said bed including a first set of bristles oriented generally vertically and having pointed upper ends the points of which form said support surface of said bed, and a second set of generally vertical bristles substantially uniformly interspersed with said first set of bristles, the bristles of said second set having blunt upper ends located slightly below the plane containing said points of said first set of bristles.

4. A machine for cutting sheet material supported on a support surface in spread condition, said machine comprising a bed providing bristles having ends generally located in a common horizontal plane and forming a support surface for supporting sheet material in spread condition, the ends of at least some of said bristles which are located in said common plane being pointed so that when a sheet of penetrable sheet material is spread onto said support surface said pointed ends of said bristles penetrate said sheet at least to some extent to inhibit movement of said sheet in the plane of said support surface, said bristles with pointed ends each having a base end opposite its pointed end and a length (L) measured between its pointed end and its base end, each of said bristles with pointed ends having a first portion extending form its base end for a distance equal to at least three-fourths of said length (L) of the bristle and a second portion following said first portion which second portion has a length equal to one-fourth or less of said length (L) of the bristle and which second portion is shaped to define said pointed end of the bristle, said first portion of each bristle with a pointed end having a cross-section of substantially constant size and shape along its length, a cutter movable in two coordinate directions over and relative to said support surface for cutting sheet material spread on said support surface along a two-dimensional line of cut, said cutter including a cutter blade which in the process of cutting said sheet material passes through said sheet material and penetrates into said bed, and means for directing a flow of air at positive pressure from above said support surface downwardly toward sheet material spread on said support surface to urge such material onto said pointed upper ends of said bristles, said cutter having a cutting tool and a presser foot surrounding said cutting tool, said means for directing a flow of air downwardly toward the sheet material spread on said support surface including air outlets in said presser foot.

5. A bed for supporting sheet material in a spread condition, said bed comprising means providing bristles having ends generally located in a common horizontal plane and forming the support surface of said bed, the ends of at least some of said bristles which are located in said common plane being pointed so that when a sheet of penetrable sheet material is spread onto said support surface said pointed ends of said bristles penetrate said sheet at least to some extent to inhibit movement of said sheet in the plane of said support surface, said bristles with pointed ends each having a base end opposite its pointed end and a length (L) measured between its pointed end and its base end, each of said bristles with pointed ends having a first portion extending from its base end for a distance of at least three-fourths said length (L) of the bristle and a second portion following said first portion which second portion has a length equal to one-fourth or less of said length (L) of the bristle and which second portion is shaped to define said pointed end of the bristle, said first portion of each bristle with a pointed end having a cross-section of substantially constant size and shape along its length, said bristles being oriented generally vertically and the ends of said bristles which form the support surface of said bed being the upper ends of said bristles, and said bristles each having an upper end portion defining an upwardly facing plateau surface and a pointed projection extending upwardly from said plateau surface.

6. A machine for cutting sheet material supported on a support surface in spread condition, said machine comprising a bed providing bristles having ends generally located in a common horizontal plane and forming a support surface for supporting sheet material in spread condition, the ends of at least some of said bristles which are located in said common plane being pointed so that when a sheet of penetrable sheet material is spread onto said support surface said pointed ends of said bristles penetrate said sheet at least to some extent to inhibit movement of said sheet in the plane of said support surface, said bristles with pointed ends each having a base end opposite its pointed end and a length (L) measured between its pointed end and its base end, each of said bristles with pointed ends having a first portion extending from its base end for a distance equal to at least three-fourths of said length (L) of the bristle and a second portion following said first portion which second portion has a length equal to one-fourth or less of said length (L) of the bristle and which second portion is shaped to define said pointed end of the bristle, said first portion of each bristle with a pointed end having a cross-section of substantially constant size and shape along its length, a cutter movable in two coordinate directions over and relative to said support surface for cutting sheet material spread on said support surface along a two-dimensional line of cut, said cutter including a cutter blade which in the process of cutting said sheet material passes through said sheet material and penetrates into said bed, means for producing a vacuum in the space containing said bristles, said means for producing a vacuum including means providing a compartment below a portion of said bed, means for producing a vacuum in said compartment, and means providing a plurality of individual air flow paths between said compartment and said space containing said bristles each of which paths presents a substantial resistance to the flow of air therethrough at a high volumetric rate.

7. A bed for supporting sheet material in a spread condition, said bed comprising means providing bristles having ends generally located in a common horizontal plane and forming the support surface of said bed, the ends of at least some of said bristles which are located in said common plane being pointed so that when a sheet of penetrable sheet material is spread onto said support surface said pointed ends of said bristles penetrate said sheet at least to some extent to inhibit movement of said sheet in the plane of said support surface, said bristles with pointed ends each having a base end opposite its pointed end and a length (L) measured between its pointed end and its base end, each of said bristles with pointed ends having a first portion extending from its base end for a distance of at least three-fourths said length (L) of the bristle and a second portion following said first portion which second portion has a length equal to one-fourth or less of said length (L) of the bristle and which second portion is shaped to define said pointed end of the bristle, said first portion of each bristle with a pointed end having a cross-section of substantially constant size and shape along its length, said bristles being oriented generally vertically and the ends of said bristles which form the support surface of said bed being the upper ends of said bristles, and other generally vertical bristles substantially uniformly interspersed with said bristles with pointed upper ends, said other bristles having blunt upper ends located slightly below said common horizontal plane of said support surface.

8. A bed for supporting sheet material as defined in claim 7 further characterized by said blunt upper ends of said other bristles being located in another plane spaced between 0.010 inch and 0.040 inch below said horizontal plane containing said pointed upper ends.

9. A bed for supporting sheet material as defined in claim 7 further characterized by said bristles with pointed upper ends comprising approximately fifty percent of the total number of bristles of said bristle bed and said bristles with blunt upper ends comprising the remainder of the bristles of said bristle bed.

10. A bristle bed as defined in claim 7 further characterized by said bristles with pointed upper end and said bristles with blunt upper ends all being less than one-half inch long, all being of generally cylindrical shape, and all having diameters at their lower ends of greater than 0.020 inches, and said bristles with pointed upper ends and said bristles with blunt upper ends together being packed to a density of more than 500 bristles per square inch.

11. A bed for supporting sheet material in a spread condition, said bed comprising means providing bristles having ends generally located in a common horizontal plane and forming the support surface of said bed, the ends of at least some of said bristles which are located in said common plane being pointed so that when a sheet of penetrable sheet material is spread onto said support surface said pointed ends of said bristles penetrate said sheet at least to some extent to inhibit movement of said sheet in the plane of said support surface, said bristles with pointed ends each having a base end opposite its pointed end and a length (L) measured between its pointed end and its base end, each of said bristles with pointed ends having a first portion extending from its base end for a distance of at least three-fourths said length (L) of the bristle and a second portion following said first portion which second portion has a length equal to one-fourth or less of said length (L) of the bristle and which second portion is shaped to define said pointed end of the bristle, said first portion of each bristle with a pointed end having a cross-section of substantially constant size and shape along its length, and means for producing a vacuum in at least part of the space containing said bristles, said means for producing a vacuum in at least part of the space containing said bristles including a means for producing said vacuum in only that part of the space containing said bristles which registers with a selected area of said support surface.

12. A bed for supporting sheet material in a spread condition, said bed comprising means providing bristles having ends generally located in a common horizontal plane and forming the support surface of said bed, the ends of at least some of said bristles which are located in said common plane being pointed so that when a sheet of penetrable sheet material is spread onto said support surface said pointed ends of said bristles penetrate said sheet at least to some extent to inhibit movement of said sheet in the plane of said support surface, said bristles with pointed ends each having a base end opposite its pointed end and a length (L) measured between its pointed end and its base end, each of said bristles with pointed ends having a first portion extending from its base end for a distance of at least three-fourths said length (L) of the bristle and a second portion following said first portion which second portion has a length equal to one-fourth or less of said length (L) of the bristle and which second portion is shaped to define said pointed end of the bristle, said first portion of each bristle with a pointed end having a cross-section of substantially constant size and shape along its length, said bristles being oriented generally vertically with the ends thereof forming said support surface being their upper ends, each of said bristles having a lower portion of generally cylindrical shape and an upper portion the cross-section of which diminishes smoothly from that of said lower portion to a point at the upper end of the bristle, and means for producing a vacuum in the space containing said bristles, said means for producing a vacuum including means for producing said vacuum in the space containing said bristles only over a selected portion of said support surface.

13. A bristle block for use in making a bristle bed for supporting sheet material in a spread condition, said bristle block comprising a base and a plurality of bristles extending upwardly from said base, the upper ends of at least some of said bristles being located in a common horizontal plane and being pointed, said bristles with pointed upper ends each having a base end adjacent said base and a length (L) as measured between said base end and its pointed upper end, each of said bristles with a pointed upper end also having a lower portion extending upwardly from said base end for a distance equal to at least three-fourths of said length (L) of the bristle and having an upper portion following said lower portion which upper portion has a length equal to one-fourth or less of said length (L) of the bristle and which upper portion is shaped to define said pointed end of the bristle, said lower portion of each bristle with a pointed upper end having a cross-section which is of substantially constant size and shape along its length, said bristle block including other bristles with blunt upper ends, sand blunt upper ends of said other bristles being located below the pointed upper ends of said pointed bristles.

14. A bristle block as defined in claim 13 characterized by said bristles with pointed upper ends comprising approximately fifty percent of the total number of bristles of said bristle block and said other bristles with blunt upper ends comprising the remainder of the bristles of said bristle block.

15. A bristle block as defined in claim 13 further characterized by all of said bristles of said bristle block being less than one-half inch long, having generally circular cross-section and having diameters at their lower ends of greater than 0.020 inches, said bristles further being packed to a density of more than 500 bristles per square inch.

16. A bristle block as defined in claim 13 further characterized by said blunt upper ends of said bristles with blunt upper ends being located between 0.010 inch and 0.040 inch below the points of said bristles with pointed upper ends.

* * * * *